United States Patent [19]

Thomson

[11] 4,336,914

[45] Jun. 29, 1982

[54] DEPLOYABLE WING MECHANISM

[75] Inventor: Keith D. Thomson, Hawthorn, Australia

[73] Assignee: The Commonwealth of Australia, Canberra, Australia

[21] Appl. No.: 102,981

[22] Filed: Dec. 11, 1979

[30] Foreign Application Priority Data

Dec. 29, 1979 [AU] Australia ..... PD 7238

[51] Int. Cl.[3] ..... B64C 3/40

[52] U.S. Cl. ..... 244/46

[58] Field of Search ..... 244/49, 46, 47, 3.27–3.29

[56] References Cited

U.S. PATENT DOCUMENTS

| | | | |
|---|---|---|---|
| 1,485,163 | 2/1924 | Braun | 244/49 X |
| 2,572,421 | 10/1951 | Abel | 244/49 |
| 2,924,175 | 2/1960 | Jasse | 244/138 A X |
| 3,165,281 | 1/1965 | Gohlke | 244/49 |
| 3,643,599 | 2/1972 | Hubich | 244/138 A X |
| 3,790,104 | 2/1974 | Jones | 244/3.27 |
| 4,022,403 | 5/1977 | Chiquet | 244/46 |

FOREIGN PATENT DOCUMENTS

| | | | |
|---|---|---|---|
| 1199664 | 9/1962 | Fed. Rep. of Germany | 244/3.27 |

*Primary Examiner*—Robert B. Reeves
*Assistant Examiner*—Gene A. Church
*Attorney, Agent, or Firm*—Cushman, Darby & Cushman

[57] ABSTRACT

A deployable wing assembly using an inner wing segment and an outer wing segment. The inner wing segment is hinged longitudinally to the body of a missile, or the like, and with the outer wing segment hinged by a pin perpendicular to the surface of the wing segments at the junction, and including deploying and locking arrangements for both sections.

17 Claims, 15 Drawing Figures

DEPLOYABLE WING MECHANISM

This invention relates to a deployable wing mechanism.

BACKGROUND OF THE INVENTION

It is already known to have on missiles, aircraft and similar mechanisms, wings which can be moved from a stowed to an active position or from a trailing to an extended position, the purpose generally being to allow the wings to be positioned according to requirements, such as in the case of navy planes where it is necessary to fold the wings or in the case of high speed aircraft where it is necessary to use swing wings. It is thus known to so mount the wings on the fuselage or body of a missile that they can be variously positioned according to requirements.

Typical examples of movable wings are shown in the following United States patents:

U.S. Pat. No. 2,572,421 Abel, which shows an aircraft with a fixed stub wing supporting a main wing section through pivoting means which allow the wing to be rotated through 90° and then swing back to lie parallel to the fuselage. This folding is not possible in flight.

U.S. Pat. No. 4,022,403 Chiquet, which uses a wing hinged directly to the fuselage about a vertical pivot and provided with hydraulic means to allow the wing to be extended or folded back along the fuselage, the purpose however being to reduce overall width when the aircraft moves along a narrow path when not airborne.

It is also known in modern high speed aircraft to use such an arrangement to allow the wings to be swept back in flight for greater aerodynamic efficiency at high speeds yet, when extended, to allow reasonably low landing speeds.

U.S. Pat. No. 1,485,163 Braun, which is a relatively early Patent, dated 1924, and has a stub wing mounted on the fuselage by means of a hinge arranged longitudinally on the fuselage, and has an outer wing section joined to it by a vertical pivot pin, the object being stated to be to provide wings which can be folded similarly to the wings of birds. The earlier specification includes bracing means to cause both wings to be positioned similarly. Reference is also made to the folding facility being useful in transporting of flying machines and to give improving storage. The specification also refers to increasing possible wing spread. The hinging both of the stub wing to the fuselage and the outer wing post to the stub wing is by single hinge means not suitable in modern missiles and high speed aircraft and the wings are not shaped to facilitate folding against the body nor to follow body contours, and use a special construction which simulates feathers as without these the folding would not generally be possible.

OBJECTS OF THE INVENTION

It is an object of the present invention to provide certain improvements to deployable wing assemblies, the principal object being to allow the wings to fold in an effective manner but to allow the wings to extend when required so that for instance a missile can be ejected from a tube or barrel and when airborne can have the wings deployed.

A further object is to so arrange the wing assembly that when in a stowed position there is minimal projection from the shell of the missile or fuselage to which the wing structure is attached.

A still further object is to provide the necessary rigidity in flight and the ability to control the rate of deployment and to achieve a balanced operation and simultaneous positioning and to provide effective locking both when the wings are stowed or deployed.

SUMMARY OF THE INVENTION

The objects of the present invention are achieved by having each wing of an airborne missile, aircraft or marine device arranged to have an inner and an outer wing segment connected together to be generally coextensive when deployed and arranged to be stowed against the body, first hinge means connecting an inner edge portion of the inner wing segment to the body and along a generally longitudinally disposed axis on the body, second hinge means connecting the outer wing segment to an edge portion of the inner segment remote from the first hinge means, the second hinge means being disposed generally at right angles to the surface of the said inner and outer wing segments at the second hinge means, means to move and hold the inner wing segment angularly about the first hinge means in relation to the body, and means to move and hold the outer wing segment angularly about the second hinge means in relation to the first wing segment, whereby both wing segments can lie adjacent to the body or can be deployed outwards to selected positions, wherein: the outer wing segment has substantial extension behind the inner wing segment, both when folded or deployed, whereby the hinging means for the outer wing segment are near the body and only the root end of the outer wing section is engaged in a hollow in the inner wing section so that the wing sections can be contoured to give high aerodynamic efficiency without the shape of the major part of the outer wing section being determined by it having to fit into a hollow of the inner wing section.

It will be realised that the invention, among other things, allows highly manouvrable ground or air-launched cruise missiles to be produced which can be launched from either tubes or aircraft bomb racks or bomb bays, the invention applying also to torpedos or other marine devices.

Figure 1:
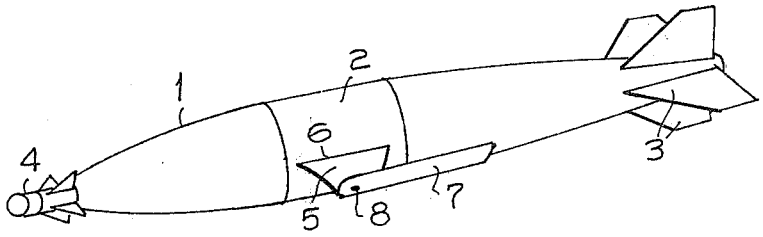
FIGS. 1, 2 and 3 are schematic views of the invention as applied to an airborne missile, FIG. 1 showing the wing structure folded against the body of the missile, FIG. 2 showing the inner wing segments deployed but with the outer wing segments trailing in the position they occupy when folded and FIG. 3 showing the missile with both the inner and outer wing segments deployed.
Figure 2:
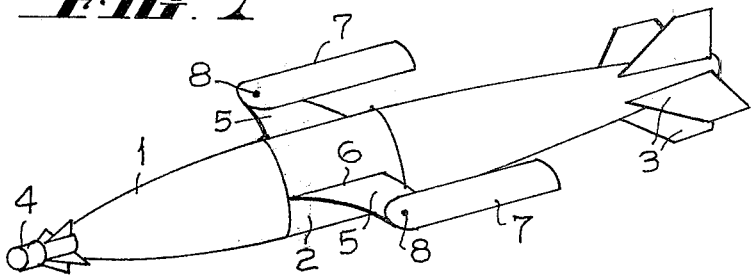
Figure 3:
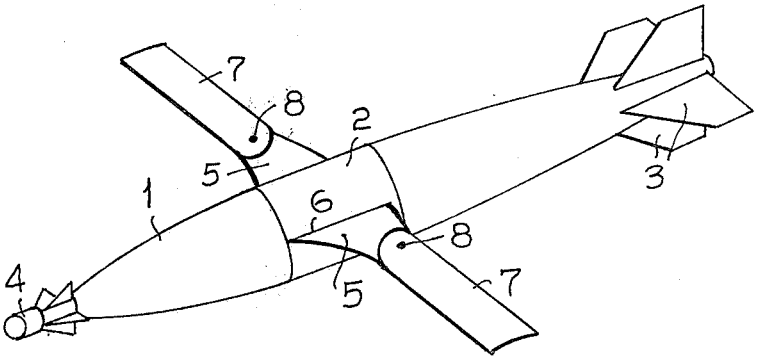

Referring first to FIGS. 1, 2 and 3 it will be seen that the body 1 of a missile has a centre body section 2 on which the wings are mounted and has the usual tail fins 3 and control system 4.

The inner wing segments 5 are joined to the centre section 2 of the body on a longitudinal axis 6 and, as will be seen, the inner wing segments 5 are shaped to fit to the body when their free ends are swung inward about the axis 6.

The outer wing segment 7 is hinged to the outer part of the inner wing segment 5 on an axis 8 which is perpendicular to the surface of the inner wing segment, any suitable mechanism being used to move the segments from a folded to a deployed position.

In the following description, similar members will be referred to by similar identification members.

Figures 4, 5:
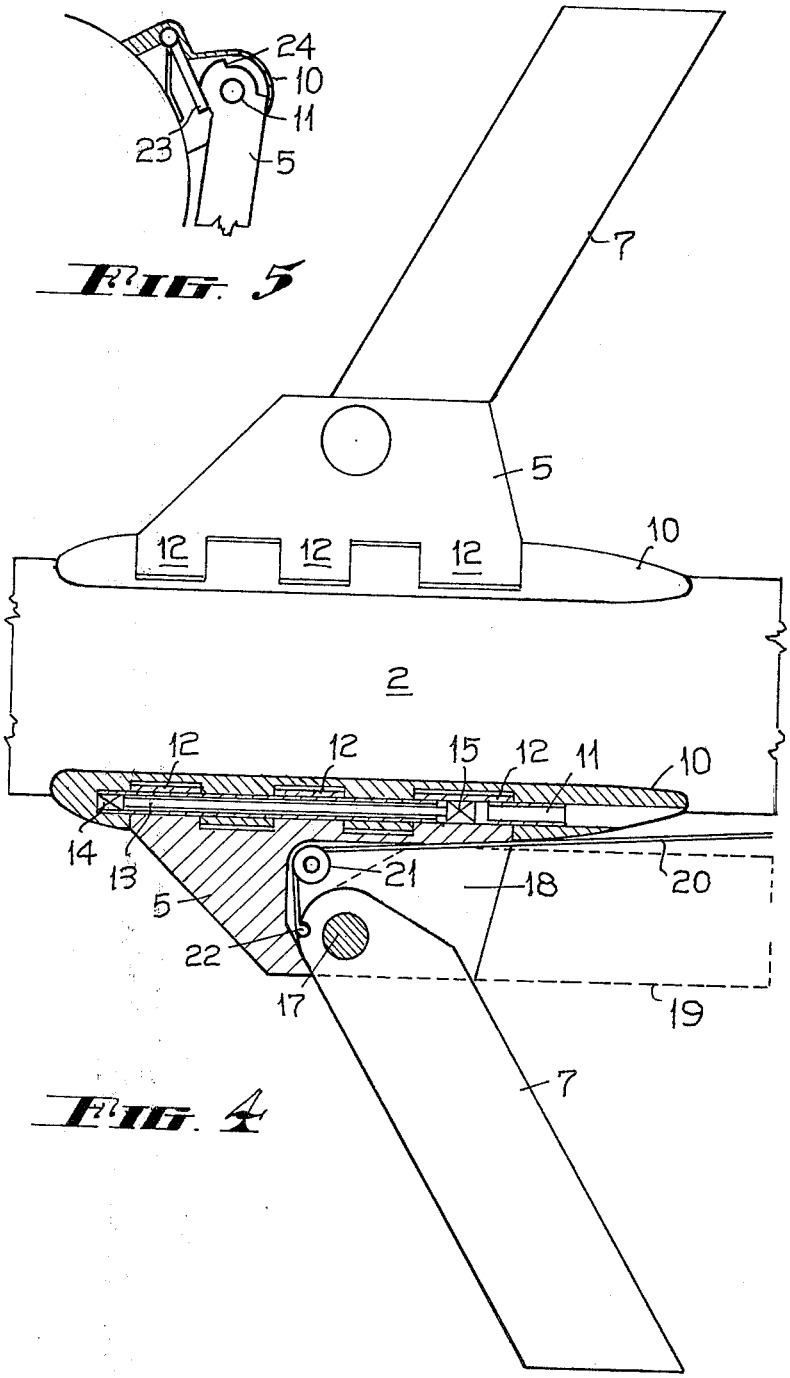
FIG. 4 is a somewhat schematic part sectional view of a typical wing structure with both the outer and inner wing segments deployed.
FIG. 5 is a schematic detailed view showing how the inner wing segment is locked when in the deployed position.

FIG. 4 is a typical example of how the inner wing segment 5 and the outer wing segment 7 can be mounted in relation to the body 2 of the missile and in relation to each other, pods 10 being secured to the body 2 of the missile 1, one on either side of the body, and these pods carry a hollow shaft 11 about which the inner segments 5 of the wing are orientated, the wing segment including extending hinge members 12 which encircle the shaft 11 and by co-acting with the pod align the wing longitudinally in respect to the pods and the body 1.

The hollow shaft 11 has in it a torsion bar 13 which is fixed at the end 14 to the pod and at the end 15 to the inner wing segment 5 and this torsion rod is so arranged that when the wing segment 5 is released from a folded position, the torsion member will orientate the inner wing segment 5 about the shaft 11 to bring it out to its fully deployed position.

The outer wing segment 7 has near its inner end an aperture which engages a pivot pin 17, the inner end of this outer wing segment 7 fitting into a recess 18 in the inner wing segment 5 so that it can lie along the body of the missile in the position indicated by the dotted lines 19 in FIG. 4 but can be deployed outwardly about the pivot pin 17 when this is required, the deploying force being supplied by means of a cable 20 connected to any suitable mechanism which passes over a guide pulley 21 secured in the recess 18 of the inner segment 5 of the wing and having its end rigidly fixed at 22 to the outer wing segment 7.

The inner wing segment 5 is locked in its deployed position by means of a detent 23 (see FIG. 5) secured to pivot in the pod 10 and is loaded by means of a spring so that as the wing is outwardly deployed by the torsion bar 13 the free end of the detent 23 is positioned behind the shoulder 24 at the root of the inner wing segment 5 to then firmly hold the wing segment in its deployed position.

From the foregoing it will be realised that a device is provided in which the inner wing segment is supported from the body 2 of the missile by pods 10 which carry a shaft 11 which in turn engages the root part of the inner wing segment 5 to allow this segment to swing from a position where it lies against the body of the missile to a position where it is extended as shown for instance in FIG. 3 of the drawings and it will be realised also that when tension is applied to the cable 20 the outer wing segment 7 will be deployed by swinging about the pivot pin 17 and can then be held by tension maintained on the cable 20 or can be locked by other means as will be understood from a description of other embodiments of this device.

Figure 6:
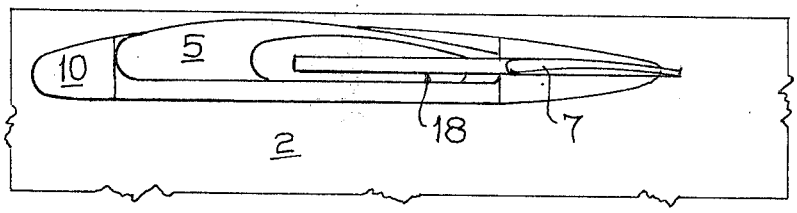
FIG. 6 is a side elevation of a wing with both segments in the deployed position.

In FIG. 6 is shown how the wings in their deployed position project from the pods 10, the inner wing segment 5 having the recess 18 formed in it, this view showing how both the inner wing segment 5 and the outer wing segment 7 can be given an air-foil shape.

Figure 7:
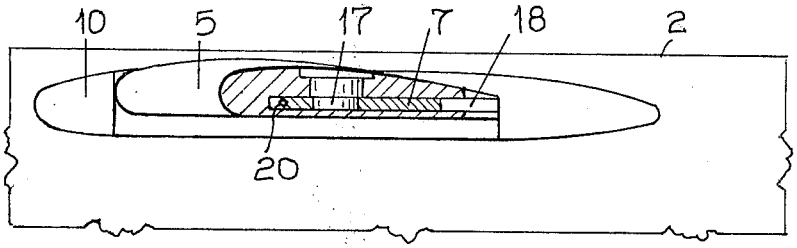
FIG. 7 is a similar view but with the wing segments sectioned on the plane of the pivot between the inner wing segment and the outer wing segment.

In FIG. 7 is shown particularly how the inner part of the outer wing segment 7 fits into the recess 18 in the inner wing segment 5 and is held by the pivot pin 17 so that it can orientate within the cavity to move from a folded to a deployed position, the cable 20 being shown by means of which the outer wing segment 7 is deployed.

Figure 8:
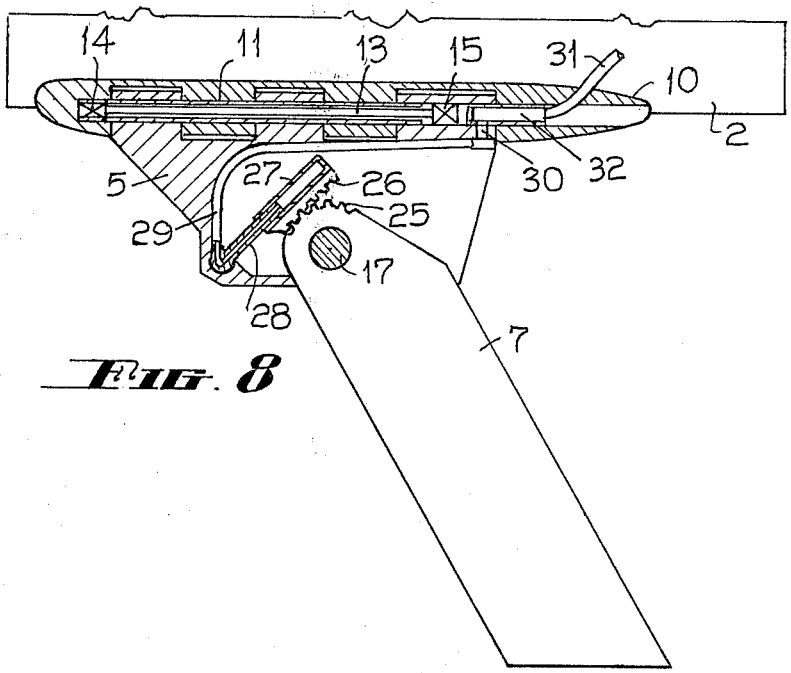
FIG. 8 is a schematic plan showing how the inner wing segment can be deployed by means of a torsion bar in the hinge shaft and showing how the outer wing segment is deployed by a hydraulic mechanism.

Referring now to FIG. 8 this shows a further method of deploying the outer wing segment 7, the inner wing segment 5 being again supported on the hollow shaft 11 which has in it the torsion bar 13 fixed at the end 14 to the pod 10 and fixed at the end 15 to the inner segment 5 of the wing so that again the inner segment of the wing can be swung outwardly into the deployed position, using if necessary the locking means of FIG. 5 to hold it in that position, although it may be sufficient to hold it against a stop by means of the torsion spring.

The outer wing segment however in this form of the device has a toothed segment 25 which is engaged by toothed rack 26 on a cylinder 27 which fits over a hollow piston 28 to which pressure fluid can be supplied by means of a line 29 to move the cylinder 27 outwardly to deploy the wing through the engagement of the rack 26 with the toothed segment 25 on the wing, the fluid line 29 in this case being arranged to form a control valve 30 which is so arranged that pressure fluid from the line 31 enters the cavity of the part 32 of the hollow shaft which registers with the line 29 only when the inner segment of the wing 5 is fully extended to allow a flow of pressure fluid to the cylinder 27 to then deploy the outer segment of the wing 7.

Figures 9, 10:
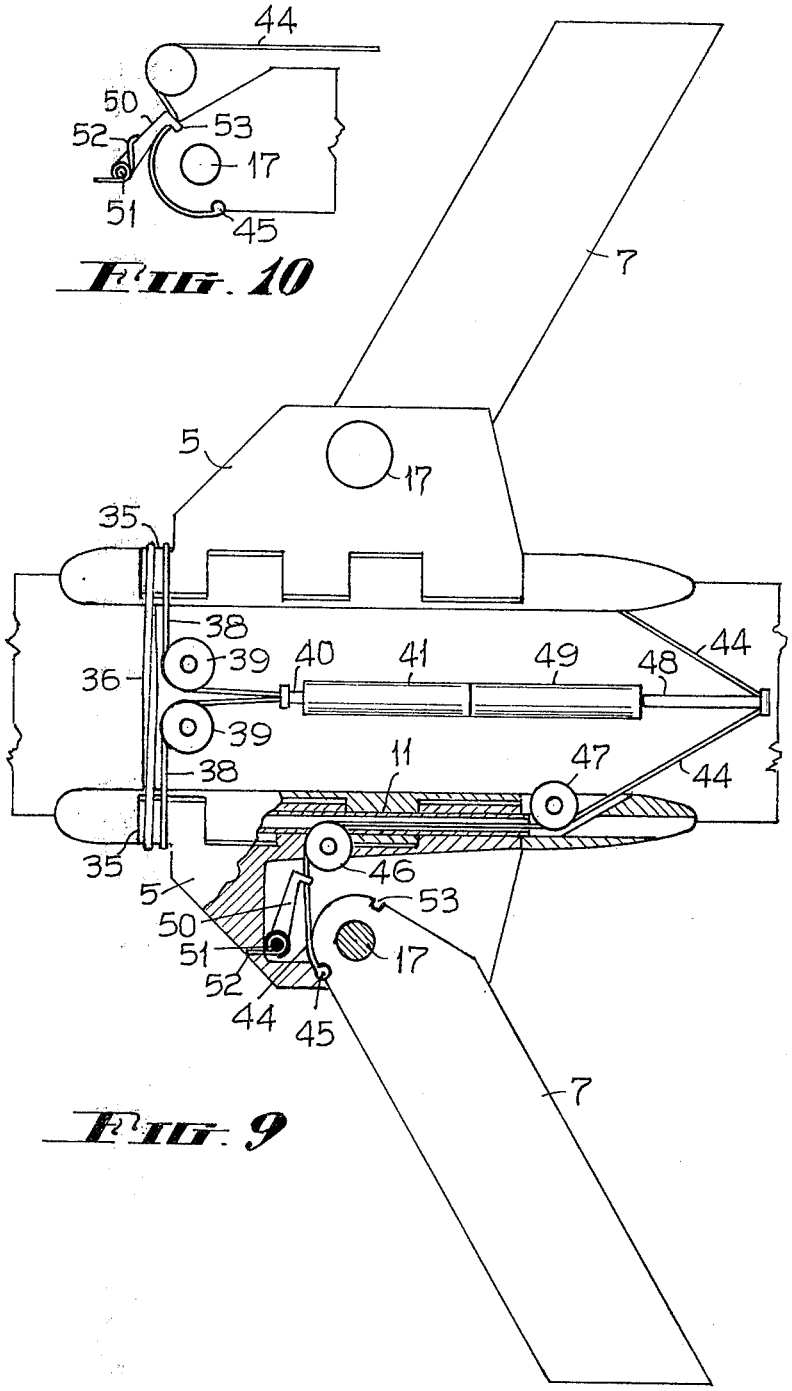
FIG. 9 is a view similar to FIG. 4 but showing how cable mechanisms can be used for deploying both the inner and outer wing segments.
FIG. 10 is a detailed view showing how the outer wing segment can be locked in its folded position prior to it being unlocked and deployed by a cable.

Referring now to FIG. 9 where a different form of mechanism is shown for deploying the wing segments 5 and 7, the pods 10 again carry the hollow shaft 11 by means of which the inner segments 5 of the wing are orientatable about the pods, but in this case the wing segments 5 are provided with the cylindrical portions 35 which are inter-connected by a cable 36 which passes around the cylindrical section 35 in a "crossed-belt" relationship, the cable 36 being locked to the cylindrical sections 35 at an appropriate position so that no slip occurs so that by this mechanism the two inner wing sections 5 are caused to move similarly so that the wings are simultaneously folded or simultaneously deployed to ensure symmetry during deployment operation.

Movement of the inner wing segments 5 is achieved by means of a pair of cables 38 which also pass around the cylindrical sections 35 of each inner wing segment 5 and again are locked to ensure that there is no movement of the cables 38 in relation to the cylindrical sections 35, these two cables 38 passing around guide rollers 39 and being joined to the outer end of a piston 40 of a hydraulic ram cylinder 41.

The piston 40 is in the extended position when the inner segments 5 of the wings are in their folded or stowed position against the body, but when hydraulic fluid is supplied by any suitable means to the cylinder 41, the piston 40 is retracted to move the inner wing segments 5 into their deployed position.

By maintaining the pressure in the cylinder 41 the segments are then locked in their deployed position.

Each outer wing segment 5 is similarly moved about its pivot pin 17 by a cable 44 attached to the wing segment at 45 and extending around a pulley 46 into the hollow shaft 11 and extending down that shaft to pass around a pulley 47 to be joined to the piston 48 of a cylinder 49, the arrangement being such that when the wings are folded the piston 48 is in its inward position. When it is desired to deploy the wing segments 7, pressure fluid is applied to the cylinder 49 to force the piston 48 outwardly to pull on the cables 44 to orientate the wing segment 7 about the pivot pin 17 into the deployed position.

In FIG. 10 is shown how by using a detent 50 pivotted at 51 to the inner wing segment 5 and loaded into action by means of a spring 52, the end of the detent 50 is positioned in a notch 53 to lock the wing segment in its folded position, but by having the cable 44 passing beneath the free end of the detent 50 as shown in FIG. 10, the first pull on the cable 44 by the piston 48 dislodges the detent from the notch 53 and continued pull then holds the detent 50 in the position shown in FIG. 9 and allows the wing to be deployed to its maximum position.

It will be realised that the form of control described in the preceding figures can be varied according to requirements.

Figure 11:
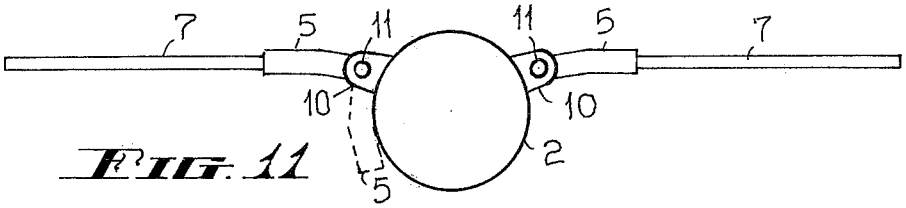
FIG. 11 is a schematic front elevation of a missile showing how the inner and outer wing segments can be located on pods on two sides of the missile body.

In FIG. 11 is shown diagrammatically how the inner wing segments 5 are connected to pods 10 disposed on either side of the body 2 of the missile, and by the dotted line is indicated how the inner wing segment 5 folds against the body 2, the outer wing segment 7 being shown deployed. When not deployed, the outer wing segment projects back, or it may project forwardly, to be along the body of the missile.

Figure 12:
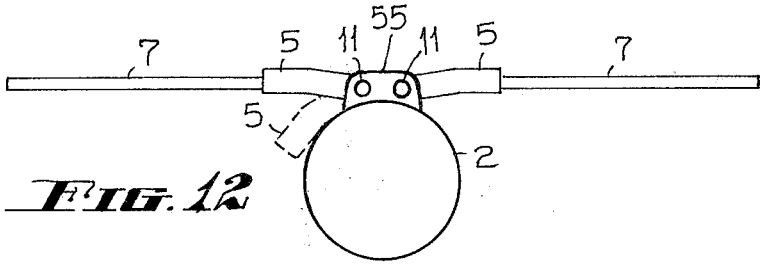
FIG. 12 is a similar view but showing how the wing segments can be mounted on adjacent hinging means.

Generally that is the position of the pods as described in the foregoing embodiments but it will be realised that the attachment can be otherwise arranged as is shown in FIG. 12 where a single pod 55 is used at the top of the body to support a pair of shafts 11 which again carry the inner segments 5 of the wings which in turn carry the outer segment 7.

Instead of using two pods with a shaft 11 in each, or using a single pod as 55 with two shafts 11 disposed therein, it is possible to use a single shaft 11 engaging a single pod 56 and in this case again the inner wing segments 5 engage the shaft 11 and again folding of the inner sections 5 of the wing takes place against the body 2 of the missile, as shown in dotted lines, the roots of the inner wing sections being appropriately designed to form hinge members which engage the shaft 11 in an interleaved relationship. This can be achieved by appropriately reducing the width of the hinge members shown in FIG. 4 so that they can be interleaved.

Figure 13:
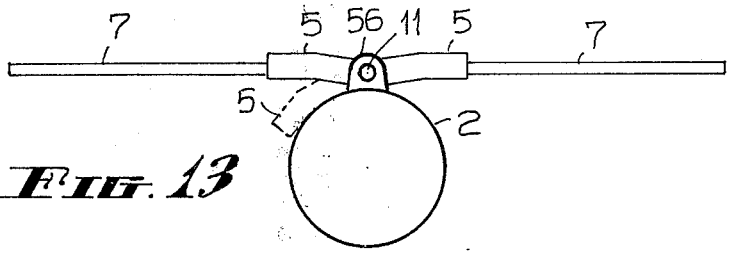
FIG. 13 is a similar view but showing the wing segments mounted on a single hinging axis.
Figure 14:
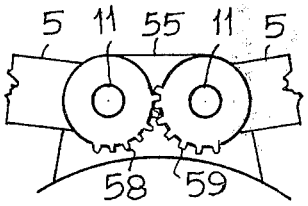
FIG. 14 shows how the wing segments of FIG. 12 can be geared together for similar movement.
Figure 15:
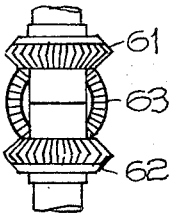
FIG. 15 shows how the wing segments of FIG. 13 can be geared together to move synchronously.

The mechanism for operating the inner wing segments 5 to move in unison in the forms shown in FIGS. 12 and 13 can be as shown in FIGS. 14 and 15, the inner wing segments 5 in the case of FIG. 14 having toothed segments 58 and 59 which interengage so that both wing segments 5 must move together when being deployed from the folded position or when folding.

In the case of FIG. 15 the wing segment on one side is connected to a bevel pinion 61 while the wing section on the other side is connected to the bevel pinion 62 and these two pinions are interconnected by a bevel wheel 63 disposed as shown so that when the bevel wheel 63 is rotated, the two toothed segments 61 and 62 move in opposite direction to cause the inner wing segments 5 to similarly move oppositely.

It will be realised of course that variation in the structures for moving the wing segments is possible within the spirit of this invention and it will be realised also that electrical control of the wing segments is possible but such variations of a construction will lie within the spirit of the present invention.

From the foregoing description it will be realised that a missile or craft constructed in this way can have the inner wing segments 5 folded to lie along the body but hinged to either extend upwardly or downwardly from the longitudinal fore and aft axis of the body according to the position of the bearing mounts, and when the inner wing segment on each side is folded in, the outer wing segment, which extends generally in the same plane as the inner wing segment will also lie along the body, either forwardly or rearwardly, so that in a frontal view the deployable wing structure fits to the body to give little increase in frontal area, making it possible to mount the missile in a tube from which it can be discharged by known means and thus making it possible to have a device which can be fired from a tube or barrel and will then deploy the wings at the required time.

The dimensions of the wings will be dependent on the weight to be carried and the fluid medium in which the device is used, and it will be realised that particularly the inner wing segments can be given a curvature so that they lie neatly along the body of the device, and as the outer wing segments are a swing wing which projects out from the inner wing segment and does not have to be retracted into the inner wing segment, much greater latitude in shape and operation results.

While in the foregoing description inner and outer wing segments are referred to, it will be appreciated that a further wing segment could be pivoted to the first outer wing segment, and so on, and also more than two sets of wings could be used.

I claim:

1. A deployable wing assembly for airborne missiles, aircraft or marine devices which comprise a body having wings thereon, each comprising an inner and an outer wing segment connected together to be generally co-extensive when deployed, and arranged to be stowed against the said body, and having first hinge means connecting an inner edge portion of the said inner wing segment to said body along a generally longitudinally disposed axis on the said body, and second hinge means connecting the outer wing segment to an edge portion of the said inner segment remote from the said first hinge means, said second hinge means being disposed generally at right angles to the surface of the said inner and outer wing segments at the said second hinge means, characterized in that the inner segment chord is large enough for the outer hinge to be in such a position as to permit efficient aerodynamic fairing, further characterized in that the said outer wing segment is long relative to the said inner wing segment and projects substantially beyond the inner wing segment whereby the wing segments can be given a large extension with high aspect ratio and good aerodynamic efficiency, further characterized by means to move and hold said inner wing segment angularly about the said first hinge means in relation to the said body, and means to move and hold said outer wing segment angularly about the said second hinge means in relation to the said first wing segment, whereby both wing segments can lie adjacent the said body with the inner or outer part of the wing segment extending beyond the inner wing segment, or can be deployed to selected positions.

2. A deployable wing assembly according to claim 1 wherein the said inner wing segment is hollow and shaped to fold against the said body when stowed, and the said outer wing segment has its inner part in said hollow and a major portion extending out of the hollow in the said body to lie adjacent said body when both said wing segments are stowed.

3. A deployable wing assembly according to claim 1 wherein each said inner wing segment includes hinge members along one edge portion, and at least a hinge shaft supported by said body to engage said hinge members whereby to support the said wing segments to be positioned on opposite sides of the said body, and wherein the said inner wing segments are interconnected by coupling means to move similarly about the said hinge shafts.

4. A deployable wing assembly according to claim 3 wherein each said outer wing segment is hingedly supported from an associated inner wing segment and the said outer wing segments are interconnected by coupling means to move similarly about the said hinge means.

5. A deployable wing assembly according to claim 3 wherein a pair of hinge shafts are positioned one on each side of the said body, each connected to an associated inner wing segment.

6. A deployable wing assembly according to claim 3 wherein a single hinge shaft medial on the said body supports a pair of inner wing segments arranged to be oppositely projecting.

7. A deployable wing assembly according to claim 1 wherein at least the said inner wing segments are loaded to deploy when released from a stowed position.

8. A deployable wing assembly according to claim 7 wherein each said inner wing segment is orientatably supported on a hinge shaft attached to the said body, and said hinge shaft includes a torsion bar attached at one part to the said body and at a remote part to the said inner wing segment whereby to load the said wing toward the deployed position.

9. A deployable wing assembly according to claim 1 wherein the said inner wing segment includes hinge members along one edge portion, and by at least a hinge shaft supported on said body to engage at least the hinge members of one said inner wing segment, characterised in that the said hinge shaft is arranged to transmit through it motion to orientate the said outer wing segment which is associated with that inner wing segment.

10. A deployable wing assembly according to claim 9 characterised in that the said hinge shaft is hollow and arranged to have the motion-transmitting means pass through the said hollow.

11. A deployable wing assembly according to claim 1 wherein the said first hinge means comprise hinge members along one edge portion of the said inner wing segment engaging a hinge shaft for that wing segment supported on the said body, and wherein the said second hinge means comprise a pivot pin engaging both the said inner wing segment and the outer wing segment, characterised by means rotationally interconnecting said inner wing segments disposed on opposite sides of the said body to similarly orientate the said inner wing segments about the said hinge shafts, and further characterised by means rotationally interconnecting the said outer wing segments through the said inner wing segments to similarly orientate the said outer wing segments about the said pivot pins.

12. A deployable wing assembly according to claim 11 characterised in that the said interconnecting means are coupled to operating means which cause the said inner wing segments and the said outer wing segments to deploy from a stowed position.

13. A deployable wing assembly according to claim 12 characterised by means to lock the said wing segments in stowed position but releasable when the said operating means are actuated.

14. A deployable wing assembly according to claim 11 characterised by cables which form the rotationally interconnecting means for the inner wing segments and which connect the inner wing segments to actuating means which deploy the said inner wing segments and by further cables which connect the outer wing segments to actuating means which deploy the said outer wing segments.

15. A deployable wing assembly according to claim 14 characterised in that the said cables which connect the outer wing segments to the actuating means pass through the said hinge shafts to actuating means disposed in the said body.

16. A deployable wing assembly according to claim 11 characterised by fluid operated drive means coupled to the said inner wing segments and to the said outer wing segments and means in the said body to actuate the said fluid operated drive means.

17. A deployable wing segment according to claim 11 characterised in that the said first hinge means have the said hinge shaft carried in pods on the said body.

* * * * *